United States Patent [19]

English et al.

[11] 4,307,536

[45] Dec. 29, 1981

[54] FOLDED GLIDER

[76] Inventors: Roy L. English; Irene F. English, both of P.O. Box 341, Molalla, Oreg. 97038

[21] Appl. No.: 99,930

[22] Filed: Dec. 3, 1979

[51] Int. Cl.[3] ..... A63H 27/00

[52] U.S. Cl. ..... 46/79

[58] Field of Search ..... 46/79, 80, 81, 76 R, 46/74 R, 1 L, 78

[56] References Cited

U.S. PATENT DOCUMENTS

| | | | |
|---|---|---|---|
| 2,351,504 | 6/1944 | Guillow | 46/79 |
| 3,010,250 | 11/1961 | Huston, Jr. | 46/79 |
| 3,526,989 | 9/1970 | Wallace | 46/79 |
| 4,172,337 | 10/1979 | English | 46/79 |

FOREIGN PATENT DOCUMENTS

| | | | |
|---|---|---|---|
| 2257109 | 5/1974 | Fed. Rep. of Germany | 46/79 |

*Primary Examiner*—Gene Mancene
*Assistant Examiner*—Mickey Yu
*Attorney, Agent, or Firm*—Chernoff & Vilhauer

[57] ABSTRACT

A folded glider which is constructed from a single sheet of material such as lightweight cardboard, plastic foam sheet material and the like comprises a symmetrical trough-like fuselage carrying a pair of swept-back wings and an inverted "V" tail which extends above the wings at the rear end of the fuselage. A portion of the sheet material may be folded or repositioned near the forward end of the glider, and folds defining the roots of the wings and tail may be angularly offset from one another to provide stabilizing drag at the rear of the glider.

7 Claims, 8 Drawing Figures

FOLDED GLIDER

BACKGROUND OF THE INVENTION

This invention is related to a glider airplane which may be made of folded sheet material.

Folded gliders, constructed both from paper and from other lightweight sheet material, are legion in the prior art. However, the prior art gliders are either unduly complex to construct or else have poor areodynamic quality. In addition, if they are formed by the use of a simple fold pattern, they often require the addition of a selectively placed weight to give proper balance and thereby prevent them from repeatedly stalling during flight. Folded gliders exemplary of the prior art are disclosed in Huston U.S. Pat. No. 3,010,250, and in Halsey U.S. Pat. No. 3,729,862.

SUMMARY OF THE INVENTION

The glider of the present invention is formed of sheet material and comprises a trough-like fuselage having a medial longitudinal fold, and wing root folds of the opposite direction defining wings. A slit is located in the material, extending transversely across the medial longitudinal fold and defining the leading edge of an inverted "V"-shaped tail. The sheet of material from which the glider is formed can have any overall shape. However, if the sheet of material from which the glider is formed is generally triangular, a plurality of gliders can readily be formed from a single sheet of material in a single stamping operation, as disclosed in the patent of Roy L. English for a Folded Glider and Method of Making Same, U.S. Pat. No. 4,172,337, issued Oct. 30, 1979.

The glider is formed by folding the sheet of material upwardly along the portion of the medial longitudinal fold lying forward of the transverse slit, to form a fuselage. The material rearward of the transverse slit is folded downward along a tail top fold, a continuation of the medial longitudinal fold located rearward of the fuselage, and upward along respective tail root folds on either side of the rearward portion of the glider. Wing root folds are made to extend the swept-back wings generally horizontally outward from the fuselage.

In a first embodiment a roughly triangular portion of the sheet of material is partially cut free ahead of the transverse slit, but is left as a flap attached to the rear of the fuselage. The flap is folded forward below the fuselage to form an overlapping lower fuselage, and is held forward, with its then forward edge tightly against the bottom of the fuselage, by the elasticity of the material of which the glider is made. A pair of diverging fold lines and a central "T"-shaped slit in the forward-folded flap define vertical rearward-facing surfaces at the rear end of the fuselage and tend to bend the forward extending lower fuselage, maintaining its position tightly against the bottom of the upper fuselage.

In another embodiment of the folded glider of the invention the wing root folds are arranged parallel to and spaced apart from the medial longitudinal fold, and the tail root folds are located between the wing root folds. The transverse slit extends between the front edges of the respective tail root folds, so that the tail extends upwardly from a location between the wings. Thus a thin strip of the fuselage extends rearwardly between the tail and the wings to give additional longitudinal stiffness to the glider.

In a third embodiment of the invention the transverse slit extends between the wing root folds rearwardly of the leading edges of the respective wings, and the tail extends upwardly from the rear portions of the wing roots. The wing root folds and tail root folds are not parallel with the medial longitudinal fold of the fuselage in this embodiment, however. The wing root folds converge toward the medial longitudinal fold, proceeding from the leading edge of the wing toward the trailing edge of the wing. The tail root folds converge toward the medial longitudinal fold, proceeding from the trailing edge of the tail and wings toward the leading edge of the tail. This shape provides additional flight stability, since it causes additional drag concentrated near the rearward end of the folded glider.

In yet another embodiment of the present invention a roughly triangular piece of material, which may be removed from the material of the glider, is installed in a slot within the fuselage at a position near the forward end of the glider in order to provide additional weight near the forward end of the glider to prevent repeated stalling during flight.

It is therefore an objective of the present invention to provide a folded glider airplane which may be made of a single sheet of material.

It is a further objective of the present invention to provide a folded glider which has structural rigidity and improved aerodynamic characteristics.

It is a feature of the present invention that certain portions of the material of which the glider is formed are relocated from a central position in a sheet of material from which the glider is folded toward a more forward position in the completed glider, thus improving flight characteristics of the folded glider of the present invention.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
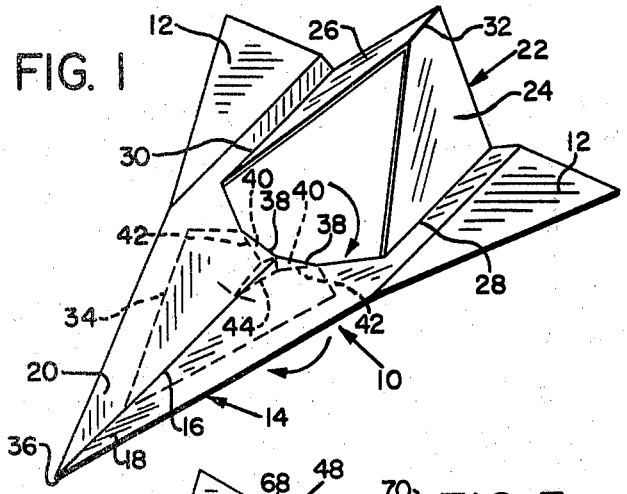
FIG. 1 is a pictorial view of an exemplary folded glider including a lower fuselage and embodying the present invention.
Figure 2:
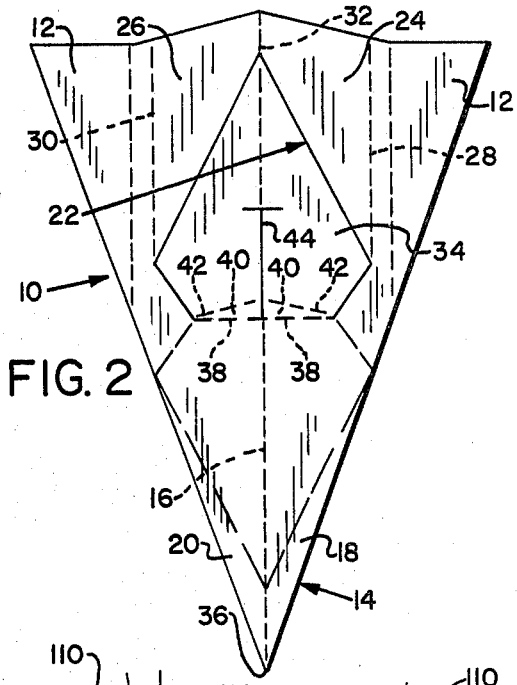
FIG. 2 is a plan view, at a reduced scale, of the folded glider shown in FIG. 1, prior to being folded.

Referring now to the drawings, in FIGS. 1 and 2 a folded glider 10 may be seen to comprise a pair of swept-back wings 12 extending horizontally from a trough-like fuselage 14 which comprises a medial longitudinal fold 16. Two symmetrical sides 18 and 20 of the fuselage extend upwardly from the medial longitudinal fold 16. A tail 22 comprising two sides 24 and 26 extends upwardly from tail root folds 28 and 30. A tail top fold 32 is located along an extension of the medial longtitudinal fold 16 of the fuselage 14 when the sheet material of which the folded glider is formed is flat; but the tail top fold 32 is folded in the opposite direction from the medial longitudinal fold 16. A lower fuselage 34 extends forward below the fuselage 14 to add additional weight near the forward end 36 of the folded glider. The lower fuselage 34 comprises a flap of the sheet material of which the glider is formed, extending forward from a transverse fold line 38. The flap is roughly triangular, however, the folded edge may be broken as shown in the drawings thereby providing an irregular shape. A pair of rearward surfaces 40 of the lower fuselage extend downward generally perpendicular to the fuselage 14.

A pair of bottom fold lines 42 and a "T"-shaped slit 44 which extends from the rearward surfaces 40 toward the forward end of the lower fuselage 34 create elastic bending of both the lower fuselage 34 and the fuselage 14, so that the front edges of the lower fuselage 34 are held tightly against the bottom of the fuselage 14. This concentrates additional weight near the forward end 36 of the folded glider, yet does not add a destabilizing amount of drag.

Figure 3:
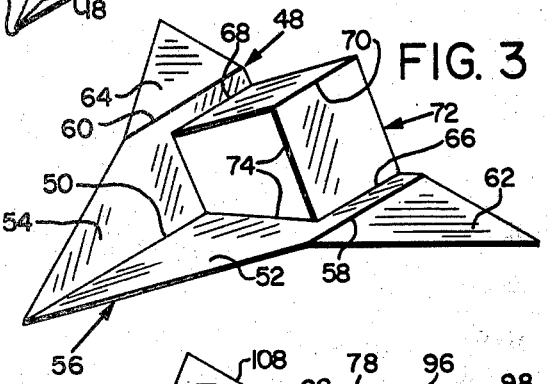
FIG. 3 is a pictorial view of a folded glider which is an alternative embodiment of the present invention.

A folded glider 48 which is a second embodiment of the invention is depicted in FIG. 3, where it may be seen that a medial longitudinal fold 50 joins two symmetrically opposite sides 52 and 54 of the trough-like fuselage 56, and wing root folds 58 and 60 join swept-back wings 62 and 64 to the fuselage. A pair of tail root folds 66 and 68 and a tail top fold 70 allow a tail 72 to extend upwardly in an inverted "V" located rearward of a transverse slit 74 which extends symmetrically across the medial longitudinal fold 50 of the fuselage 56. The tail root folds 66 and 68 are parallel to the wing root folds 58 and 60. Rearward extensions of the sides 52 and 54 of the fuselage 56 located between the wings and the tail provide support for the tail 72 and wings 62 and 64. The angularly folded material surrounding the wing root folds 58 and 60 resists bending of the wings along an extension of the transverse slit 74 which would be possible were the wing root folds 58 and 60, and tail root folds 66 and 68 merely extensions respectively of one another.

Figure 5:
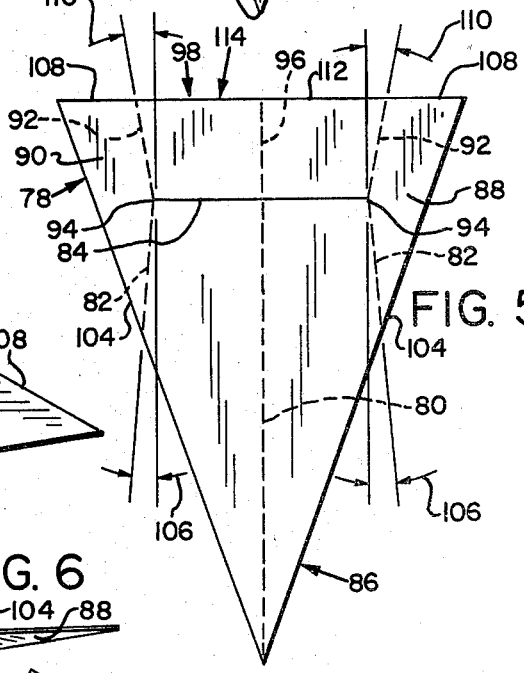
FIG. 5 is a plan view, at a reduced scale, of the folded glider shown in FIG. 4, prior to being folded.
Figure 4:
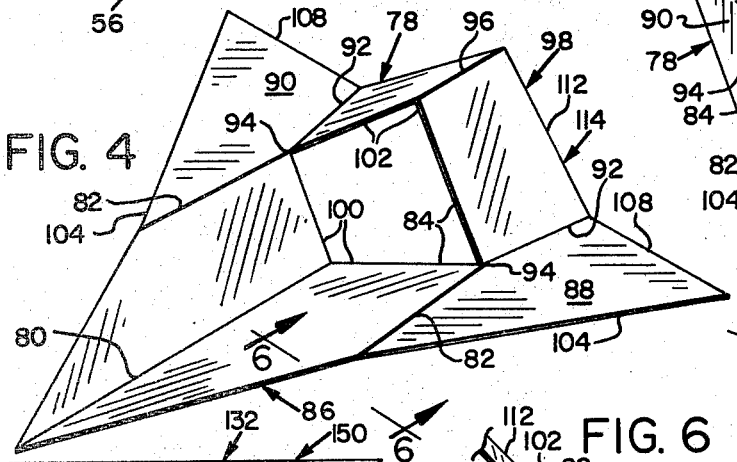
FIG. 4 is a pictorial view of a folded glider which is a third embodiment of the present invention.
Figure 6:
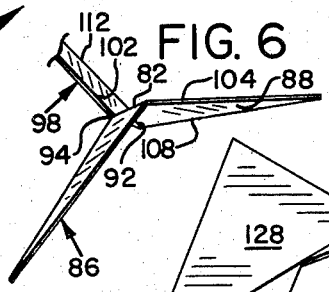
FIG. 6 is a front view of a detail of the glider shown in FIG. 4, taken along line 6—6.

A folded glider 78 which is a third embodiment of the invention, shown in FIGS. 4, 5 and 6, makes use of the flexibility of the wing to provide curvature of the wing along an extension of the transverse slit, and also provides additional drag near the rear of the glider to aid stability in flight. In this embodiment of the invention, a medial longitudinal fold 80, wing root folds 82, and a transverse slit 84 define a fuselage 86 from which wings 88 and 90 extend laterally.

Tail root folds 92 intersect the wing root folds 82 at end points 94 of the transverse slit 84. A tail top fold 96, which in the unfolded sheet material from which the folded glider is formed is an extension of the medial longitudinal fold 80, permits the tail 98 to extend upwardly as an inverted "V." The transverse slit 84 thus defines a trailing edge of the fuselage 86 and the leading edge 102 of the tail 98.

It will be noted that neither the wing root folds 82 nor the tail root folds 92 are parallel with the medial longitudinal fold 80 or with each other. Instead, the wing root folds 82 converge toward one another, being further apart at a leading edge 104 of the wings 88 and 90 and closer together at the end points 94 of the transverse slit. The wing root folds 82 thus form wing root angles 106 with respect to the medial longitudinal fold 80.

The tail root folds 92 are also non-parallel with the medial longitudinal fold 80, converging toward one another along the length of the tail root folds 92 from trailing edges 108 of the wings 88 and 90 toward the end points 94 of the transverse slit 84. The tail root folds 82 thus form tail root angles 110 with respect to the medial longitudinal fold 80. The tail root angles are preferably about twice as large as the wing root angles. The preferred size of the wing root angles is 5°, giving tail root angles of 10°, although somewhat different angles may be satisfactory for folded gliders of different relationships between wing span and overall length.

The divergence of the wing root folds from the respective tail root folds causes the trailing edges 112 of the tail 98 to be separated further than the leading edges 102 of the tail, and also causes a slight curvature of the wings 88 and 90, with a convex side of the wings being upward. The divergent tail surfaces and the curved wing surfaces cooperate to increase lift near the rear end 114 of the glider 78, reducing any tendency to repeatedly stall during flight.

Figure 8:
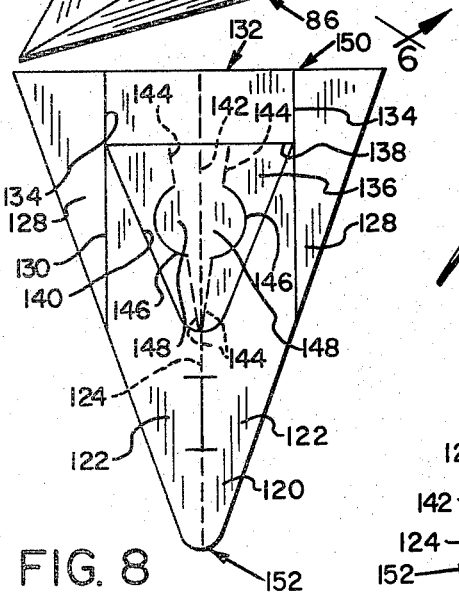
FIG. 8 is a plan view, at a reduced scale, of the glider shown in FIG. 7, prior to being folded.
Figure 7:
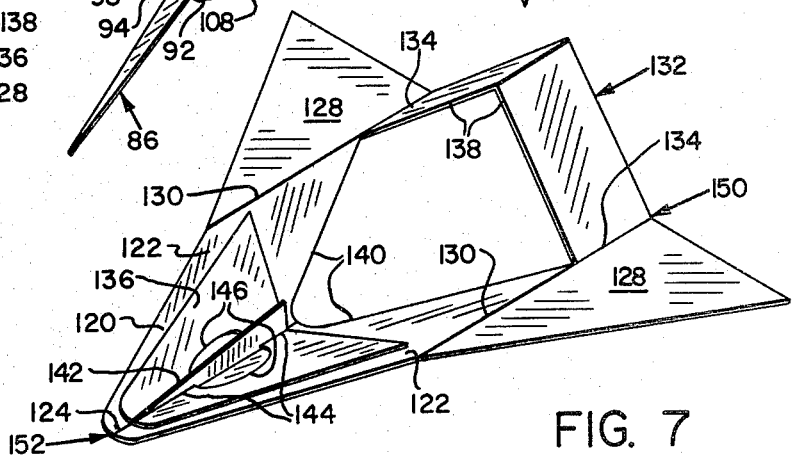
FIG. 7 is a pictorial view of a folded glider which is a fourth embodiment of the present invention.

A fourth embodiment of the invention is depicted in FIGS. 7 and 8, wherein a folded glider 118 shown in FIG. 7 is depicted in its original unfolded form in FIG. 8.

This embodiment of the invention comprises a trough-like fuselage 120 having a pair of symmetrically opposed sides 122 joined by a medial longitudinal fold 124 which has an "I"-shaped slit 126 along a portion thereof. A pair of swept-back wings 128 are joined to the respective sides 122 of the fuselage by wing root folds 130. An inverted "V"-shaped tail 132 extends upward above the wings 128 and is joined to the wings 128 by tail root folds 134. An upper fuselage 136, which is roughly triangular in shape before being folded, is formed from a roughly triangular piece of sheet material removed from the area between the leading edge 138 of the tail 132 and the trailing edge 140 of the fuselage 120. A medial fold 142 and a pair of side folds 144 converge toward the apex of the triangular upper fuselage 136.

The side fold lines 144 are interrupted by arcuate slots 146 which define arcuate tabs 148. The upper fuselage 136 may then be folded in one direction along the medial fold 142 while the material is folded in the opposite direction along side folds 144. This permits the arcuate tabs 148 to be inserted into the "I"-shaped slot 126, allowing friction between the "I"-shaped slot 126 and the arcuate tabs 148 to retain the upper fuselage 136 in position within the "V"-shaped trough of the fuselage 120. This construction both removes weight near the rear end 150 of the glider 118 and adds weight concentrated toward the forward end 152 of the glider, in order to reduce tendency of the folded glider 118 to repeatedly stall in flight.

The folded glider of the invention may be formed of sheet material such as lightweight cardboard or plastic foam sheet material, for example, or from other sheet material, as may be readily apparent to one skilled in the art.

In use the folded glider of the invention may be folded as has been previously described, and may then be flown by grasping the fuselage and lightly tossing the folded glider in a forward direction to produce smooth, level flight.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A folded glider formed of sheet material, comprising:

(a) a trough-like fuselage of "V" cross-section, and having a front end and a rear end and a medial longitudinal fold defining symmetrical fuselage side portions which extend upward from said medial longitudinal fold;

(b) a pair of swept-back wings interconnected with said fuselage side portions and extending laterally from said fuselage, said wings being defined by wing roote folds in said sheet material;

(c) an inverted "V"-shaped tail extending upwardly above said wings, said tail being defined by tail roote folds and a transverse slip extending between said tail roote folds at the leading edge of said tail;

(d) a lower fuselage comprising a roughly triangular flap of said sheet material, the shape of said flap being defined partly by said transverse slit, said flap extending forward beneath said fuselage, a transverse fold line defined in said sheet material of said fuselage, thereby providing additional weight near said front end of said fuselage; and (e) wherein said lower fuselage includes a medial longitudinal slit extending a predetermined distance from said transverse fold line and further includes a pair of folds, one of said folds extending from each side of said medial longitudinal slit toward a respective end of said transverse fold line, thereby defining a pair of triangular rearward surfaces of said lower fuselage.

2. A method of making a folded glider, comprising:

(a) folding sheet material along a medial longitudinal fold to form a trough-like fuselage having "V"-shaped cross-section, a front end, and a trailing edge, and defining symmetric upward-extending fuselage sides;

(b) folding said sheet material along respective wing root folds to form a pair of swept-back wings extending laterally from said respective fuselage sides;

(c) cutting said sheet material symmetrically across said medial longitudinal fold, forming a transverse cut extending between said wing root folds and defining a leading edge of a tail;

(d) folding said sheet material to form an inverted "V"-shaped tail extending above said wings and attached thereto by a pair of respective tail root folds;

(e) removing from said fuselage a roughly triangular piece having a trailing side defined by said transverse cut and having an apex located forward thereof, said triangular piece being arranged symmetrically about said medial longitudinal fold;

(f) forming a medial fold, a pair of convergent side folds, and a pair of arcuate tabs in said roughly triangular piece of sheet material; and (g) placing said roughly triangular piece of sheet material atop said fuselage with said arcuate tabs extending through a longitudinal slot defined in said fuselage.

3. A folded glider formed of sheet material, comprising:

(a) a trough-like fuselage having a "V"-shaped cross-section, a front end, and trailing edge, and having a medial longitudinal fold defining symmetric upwardly extending fuselage sides;

(b) a pair of swept-back wings extending laterally from said respective fuselage sides and being defined by respective wing root folds in said sheet material;

(c) an inverted "V"-shaped tail extending above said wings and attached thereto by a pair of respective tail root folds;

(d) said sheet material having a transverse cut located symmetrically across said longitudinal fold, said transverse cut extending between said wing root folds and defining a leading edge of said tail, and with said trailing edge of said fuselage, defining a roughly triangular opening in said sheet material; and (e) said fuselage including an upper fuselage located atop said fuselage thereby providing additional weight near the front end of said fuselage, said upper fuselage including a medial fold, a pair of convergent side folds, and a pair of arcuate tabs, and wherein said fuselage has defined therein a longitudinal slot extending through and along a portion of said medial longitudinal fold, said arcuate tabs extending through said longitudinal slot to locate said upper fuselage piece atop said fuselage.

4. The folded glider of claim 3 wherein said upper fuselage is a roughly triangular piece of said sheet material similar in shape to said roughly triangular opening in said sheet material defined by said trailing edge of said fuselage and said leading edge of said tail.

5. A folded glider formed of sheet material, comprising:

(a) a trough-like fuselage having a "V" cross section and having a front end, a rear end, and a medial longitudinal fold defining symmetrical right and left fuselage sides;

(b) a pair of swept-back wings extending laterally from said fuselage sides and being defined by a pair of respective wing root folds in said sheet material;

(c) an inverted "V"-shaped tail extending above said wings and attached thereto by a pair of respective tail root folds;

(d) said tail having a leading edge and said fuselage having a trailing edge, said leading edge and trailing edge being defined by a common transverse cut in said sheet material; and (e) each of said wing root folds intersecting a respective one of said tail root folds at the respective end of said transverse cut, said wing root fold and tail root fold on each side converging toward said medial longitudinal fold and the respective end of said transverse cut.

6. The folded glider of claim 5 wherein said wing root folds are each oriented at a wing root fold angle with respect to said medial longitudinal fold, said wing root folds converging toward said medial longitudinal fold over the length of said wing root folds from front to rear, and wherein said tail root folds are each oriented at a tail root fold angle with respect to said medial longitudinal fold, said tail root folds converging toward said medial longitudinal fold over the length from rear to front of said tail root folds, said wing root fold angle being within the range of 2–8 degrees and said tail root fold angle being approximately twice as large as said wing root fold angle.

7. The folded glider of claim 6 wherein said wing root fold angle is approximately 5 degrees.

* * * * *